United States Patent [19]

Beuchat

[11] 4,019,439

[45] Apr. 26, 1977

[54] ELECTRIC FIRING DEVICE FOR A PYROTECHNIC CHARGE

[75] Inventor: Roger Beuchat, Geneva, Switzerland

[73] Assignee: Mefina S.A., Fribourg, Switzerland

[22] Filed: June 23, 1975

[21] Appl. No.: 589,544

[30] Foreign Application Priority Data

July 5, 1974 Switzerland ..... 9247/74
May 30, 1975 Switzerland ..... 6967/75

[52] U.S. Cl. ..... 102/70.2 R; 102/70.2 G; 361/248

[51] Int. Cl.[2] ..... F42C 11/00

[58] Field of Search ..... 102/70.2 R, 70.2 G, 102/70.2 GA; 317/80; 336/30, 136

[56] References Cited

UNITED STATES PATENTS

| | | | |
|---|---|---|---|
| 1,739,921 | 12/1929 | Schuler et al. | 102/70.2 GA |
| 3,439,616 | 4/1969 | Godsey et al. | 102/70.2 R |
| 3,604,356 | 9/1971 | Brownig | 102/70.2 R |
| 3,657,571 | 4/1972 | Martin et al. | 102/70.2 R |
| 3,921,530 | 11/1975 | Burkhardt et al. | 102/70.2 R |

*Primary Examiner*—Stephen C. Bentley
*Assistant Examiner*—S. A. Cangialosi
*Attorney, Agent, or Firm*—Emory L. Groff, Jr.

[57] ABSTRACT

An electric firing device for a pyrotechnic charge in a projectile comprises a pulse generator, a pulse-activable firing control element, and means controlling the application of pulses to this element. Said means comprise an electromagnetic transducer including a primary winding receiving pulses from the generator, a secondary winding connected to said element and a ferromagnetic core coupling the windings. The core and windings are movable relative to one another, for example by mounting the windings in an inertia block, to vary the coupling and control firing upon impact.

7 Claims, 2 Drawing Figures

ELECTRIC FIRING DEVICE FOR A PYROTECHNIC CHARGE

The invention relates to electric firing devices for pyrotechnic charges in projectiles, and more specifically concerns such a firing device comprising a pulse generator, a firing-control element made active by the application of at least one pulse, and means for controlling the application of pulses to said element.

In projectiles, it is advantageous to be able to regulate the sensitivity of the firing device to impact. It may in certain cases be desired that the projectile explodes at the instant of impact, even if the target is in low resistance material, for example snow. In other cases, it may be required that the projectile only explodes at the moment when its head meets a relatively hard surface.

An aim of the invention is to provide a projectile with an electric firing device in which such regulation can easily be achieved by an improved means for controlling the application of pulses to the firing control element.

According to the invention, in a device of the specified type the means for controlling application of the pulses comprise an electromagnetic transducer including a primary winding receiving pulses from the generator, a secondary winding connected to said element, and a ferromagnetic core providing a coupling between the two windings, the core and at least one of the windings being movable relative to one another to vary and control said coupling.

The accompanying drawings show, schematically and by way of example, an embodiment of the invention. In the drawings.

Figure 1:
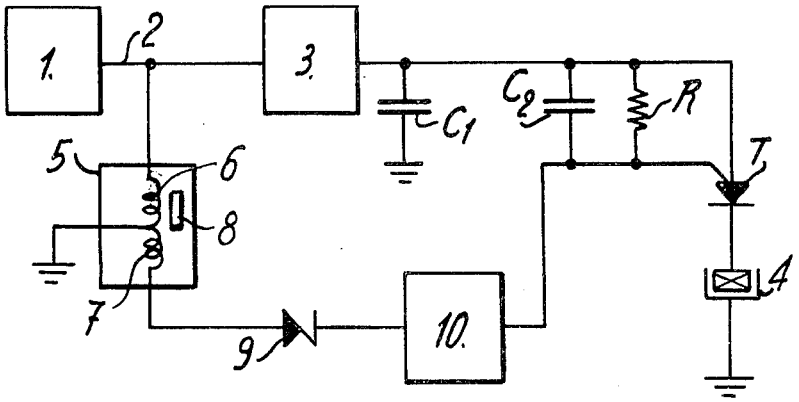
FIG. 1 is a circuit diagram of a firing device.

With reference to FIG. 1, the firing device comprises a generator 1 supplying pulses of a given (possibly adjustable) frequency. The shape of the output pulses of generator 1 is not of critical importance: the pulses may be rectangular, sawtooth or various shaped waves of constant polarity, for example obtained by rectifying a sinusoidal voltage.

This output signal is supplied by a line 2 to a circuit 3 charging a capacitor $C_1$. Capacitor $C_1$ can be discharged to fire a fuse 4 via a programmable unijunction transistor T programmed by a selected capacitor $C_2$ and/or a resistor R connected between the anode and base of transistor T.

The signal supplied by generator 1 is also applied to an electro-mechanical transducer 5 comprising basically two windings 6 and 7 and a movable ferromagnetic core 8 defining the coupling between the two windings. Winding 6 receives pulses from generator 1. These pulses generate a magnetic field in core 8, as a function of the position of the core, and this magnetic field in turn induces pulses in winding 7. When the amplitude of the induced pulses exceeds the threshold voltage of a Zener diode 9, these pulses are delivered to a counter 10 which may simply be formed by a frequency divider. When a pre-regulated number of pulses have been counted, counter 10 delivers a pulse to the base of transistor T to actuate firing of fuse 4.

This circuit has the feature that the bore safety when the projectile is fired depends not only on the delay produced by counter 10, which delay can be varied by setting the counter, but also on the time required for circuit 3 to supply a sufficient charge to capacitor $C_1$ to permit firing of fuse 4. Moreover, circuit 3 may be arranged so that after a given time, the voltage of capacitor $C_1$ reaches a sufficient value to make transistor T conduct, which permits selfdestruction of the projectile in case the impact-actuated firing control device does not function correctly. The required voltage for automatic or self switching of transistor T depends notably upon the resistance of resistor R. In contrast, the capacitance of capacitor $C_2$ determines the electric charge necessary to obtain this self-switching. The circuit may comprise either or both of these regulating elements, according to the requirements.

Of course, for pulses from generator 1 of a given amplitude, the amplitude of the pulses induced in winding 7 is determined by the electromagnetic coupling provided between the windings 6 and 7 by core 8. To obtain a given amplitude of the induced pulses, it is thus necessary that core 8 be moved through a given distance until it reaches a position at which the induced voltage in winding 7 reaches said amplitude. The amount of this displacement thus depends upon the initial position of core 8. If the initial position is close to that giving the desired coupling, a small displacement of core 8 is sufficient to reach the critical value at which the firing device becomes activated, whereas if the initial position of the core is far away from the desired coupling position, the displacement must be much greater.

Figure 2:
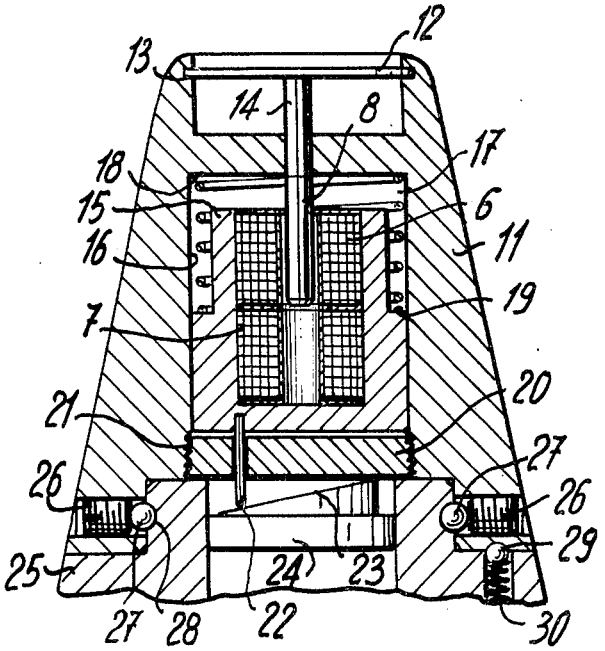
FIG. 2 is a cross-section of the head of a projectile incorporating this firing device.

FIG. 2 shows the mounting of electro-magnetic transducer 5 in a head 11 of a projectile. A recess at the front of head 11 is closed by a disc 12 clamped by its periphery in an annular groove 13. Disc 12 carries a rod 14 whose end carries the core 8 of ferromagnetic material. Core 8 can move in an inertia block 15 in which windings 6 and 7 are secured.

Block 15 is slidably mounted in a bore 16 of head 11, and is biased by a spring 17 towards the rear of the projectile. Spring 17 bears on the one hand against bottom 18 of bore 16 and on the other hand against a shoulder 19 of block 15. A disc 20 screwed in a thread 21 at the end of bore 16 holds block 15 in bore 16. The rest position of block 15 in relation to core 8 is defined by a pin 22 passing through a hole in disc 20 and abutting against a ramp 23 on an annular piece 24 carried by a body 25 of the projectile on which head 11 is rotatably mounted. Head 11 is secured on body 25 by means of screws 26 each holding a ball 27 engaged in a circular groove 28 of body 25. A ball 29 urged by a spring 30 cooperates with notches (not shown) in the base of head 11 to hold the head 11 in selected angular positions relative to body 25.

By turning head 11 on body 25, the pin 22 is moved along ramp 23 and the initial position of windings 6 and 7 relative to core 8 is modified correspondingly.

The relative movement between core 8 and windings 6 and 7 may be produced either by inertia upon a slowing down on the projectile, block 15 compressing spring 17 as it continues its forward movement as the projectile is slowed, or by pushing in of disc 12 upon impact against a target, this pushing in moving core 8 towards winding 7. Of course, the effects of inertia and pushing in may occur simultaneously.

Numerous variations may be provided. For example, block 15 could be fixedly mounted, and solely core 7 movable upon impact. In this case, the initial relative position between core 8 and block 15 could for example be adjusted by a screw enabling modification of the distance between coe 8 and disc 12. Alternatively, the block 15 could be screwed in head 11 and its axial position relative to core 8 set by screwing to a greater or lesser degree.

Conversely, core 8 could be fixed relative to the projectile, and windings 6 and 7 movably mounted relative to the core to control firing of the pyrotechnic charge of the projectile.

In each case, it is possible that only one of the windings 6, 7 be movable to reach the desired magnetic coupling. This movement could also be in a direction other than that of the trajectory of the projectile. It is also possible to use an electromagnetic transducer having more than two windings.

I claim:

1. In a projectile, an electric firing device for a pyrotechnic charge, comprising a pulse generator, a firing control element activable by at least one pulse, and control means for the application of pulses from said pulse generator to said element, said control means comprising an electromagnetic transducer mounted within said projectile and including a primary winding having first and second ends, said first end receiving pulses from said pulse generator, said second end connected to ground, a secondary winding having first and second terminals, said first terminal connected to ground, said second terminal connected to said element, a ferromagnetic core providing a coupling between the two windings, and means for mounting the core and at least one of the windings for movement relative to one another to vary and control said coupling.

2. A device as claimed in claim 1, comprising means for setting an initial relative position between the core and said at least one winding to determine the relative displacement required to produce a given degree of coupling for which the amplitude of pulses induced in the secondary winding is sufficient to activate the firing control element.

3. A device as claimed in claim 1, in which the core is movable and the two windings are fixed relative to the projectile.

4. A device as claimed in claim 1, in which at least one winding is movable and the core is fixed relative to the projectile.

5. A device as claimed in claim 1, in which at least one winding and the core are both movable relative to the projectile in opposite directions to one another.

6. A device as claimed in claim 2, in which the windings are mounted in an inertia block slidable along the axis of the projectile, and comprising a spring biasing said block rearwardly of the projectile into contact with an adjustable stop.

7. A device as claimed in claim 6, in which said adjustable stop comprises an annular piece disposed in a plane perpendicular to the projectile axis, said annular piece having an inclined face forming an abutment surface for adjusting the rest position of the block, and means for permitting an angular displacement of said annular piece relative to the part of the projectile carrying the block.

* * * * *